United States Patent [19]

Ashley

[11] Patent Number: 4,675,923

[45] Date of Patent: Jun. 30, 1987

[54] PORTABLE DECONTAMINATION UNIT

[76] Inventor: Jesse D. Ashley, 4203 Aztec, Pasadena, Tex. 77504

[21] Appl. No.: 813,056

[22] Filed: Dec. 24, 1985

[51] Int. Cl.[4] ..... A47K 3/22

[52] U.S. Cl. ..... 4/599; 4/596; 4/608; 128/1 R

[58] Field of Search ..... 4/596, 597, 599, 600, 4/602, 603, 612–614, 620, 639; 135/97; 128/1 R, 1 B, 365, 371; 312/1,3–6, 108, 198; 160/123, 124, 126, 368 R

[56] References Cited

U.S. PATENT DOCUMENTS

| | | | |
|---|---|---|---|
| 8,723 | 2/1852 | Holm | 4/603 |
| 2,188,213 | 1/1940 | Wilson | 312/3 |
| 3,293,664 | 12/1966 | Coons | 4/599 |
| 3,345,996 | 10/1967 | Sadove et al. | 128/1 R |
| 3,431,565 | 3/1969 | Nelson | 4/599 |
| 3,501,213 | 3/1970 | Trexler | 128/1 R |
| 3,925,828 | 12/1975 | Kim | 4/599 |
| 4,304,224 | 12/1981 | Fortney | 128/1 R |
| 4,348,777 | 9/1982 | Peterson | 4/596 |

FOREIGN PATENT DOCUMENTS

| | | | |
|---|---|---|---|
| 12547 | 6/1916 | United Kingdom | 4/599 |

*Primary Examiner*—Stephen Marcus
*Assistant Examiner*—Linda J. Sholl
*Attorney, Agent, or Firm*—Bill B. Berryhill

[57] ABSTRACT

A portable decontamination unit comprising: at least two pans each of which includes a bottom and side walls extending upwardly therefrom, the pans being positionable side by side so that one of the side walls of each pan lies adjacent to one of the side walls of the adjacent pan; a tent frame supportable on the pans; and a tent having a top, sides, ends and at least one intermediate partition supportable by the tent frame forming at least two compartments, the bottoms of which are the two pans. Each of the ends and partitions of the tent is formed by first, second and third curtains, the first curtain being attached along an upper edge thereof to the top of the tent and along one vertical edge thereof to one side of said tent, leaving the opposite vertical edge free. The second curtain is attached along an upper edge thereof to the top of the tent and along one vertical edge thereof to an opposite side of the tent, leaving the opposite vertical edge free. The third curtain is attached along an upper edge thereof to the top of the tent and both of the vertical edges thereof are free.

19 Claims, 10 Drawing Figures

PORTABLE DECONTAMINATION UNIT

BACKGROUND OF THE INVENTION

1. Field of the Invention

The present invention pertains to facilities for cleaning of individuals. Specifically, it pertains to facilities for cleaning or decontaminating of individuals who have been exposed to a dirty or contaminated environment. More particularly, it pertains to facilities for decontaminating workers who have been exposed to asbestos or other contaminates.

2. Description of the Prior Art

In recent years, it has been discovered that individuals who occupy buildings, portions of which are constructed of asbestos material, are subject to health hazards caused by the asbestos. This is particularly true of institutional buildings. Recent laws have been passed requiring the removal of these asbestos materials from buildings, particularly public buildings, e.g. schools, etc. There are certain procedures for making sure that as asbestos is being stripped from a room, the material is collected without contaminating other areas. The workers are also protected by wearing proper suits, hoods and respirators. However, as a worker leaves the room being stripped, it is necessary to decontaminate the worker and his protective clothing so that he does not contaminate other areas.

Decontamination of an asbestos worker is normally done by having the worker pass through a three-compartment decontamination unit. The worker enters a first compartment (contaminated change area) which may be kept under partial vacuum where he removes his contaminated clothing. Then the worker passes through a second compartment where a shower is normally located for showering and washing off any asbestos materials from his body. Finally, the worker enters a third compartments (clean change area) where he may reclothe himself and exit in a decontaminated state.

The problem with most decontamination units of the type just described is that even though they attempt to be somewhat portable, they are relatively bulky, heavy and expensive. One such unit is manufactured by Evergreen Industries, Inc. of Golden, Colorado. While such a unit is more portable and better than other solutions, it is still relatively heavy and expensive since the walls thereof are made of metal and are formed in at least a semi-permanent fashion. Since the decontamination units must be moved from one jobsite to another, these bulky compartments are not as portable as desired.

U.S. Pat. No. 4,348,777 (Peterson) discloses a portable shower facility which is divided into three compartments similar to the facility manufactured by Evergreen Industries mentioned above. However, while the shower of Peterson is semi-portable, all three compartments are mounted as a single skid unit and must be moved together.

SUMMARY OF THE INVENTION

The present invention provides a portable decontamination unit which preferably provides first, second and third pans, each of which includes a bottom and side walls extending upwardly therefrom. The pans are positionable side by side so that one of the side walls of each pan lies adjacent to one of the side walls of the adjacent pan. A tent frame is supportable on the pans and a tent having top, sides, ends and at least one intermediate partition is supportable by the tent frame to form first, second and third compartments, the bottoms of which are defined by the first, second and third pans, respectively. The tent frame may be disassembled and placed with the tent within one or more of the pans for moving from one location to another.

Another feature of the decontamination unit of the present invention is the unique construction of the ends of the tent and the intermediate partitions thereof. Each of the ends and partitions is formed by a first, second and third curtain; the first curtain being attached along an upper edge to the top of the tent and along one vertical edge to the side of the tent, leaving the opposite vertical edge free; the second curtain being attached along an upper edge to the top of the tent and along one vertical edge to an opposite side of the tent, leaving the opposite vertical edge free; and the third curtain being attached along an upper edge to the top of the tent and both the vertical edges being free. This unique arrangement is effective in sealing against drafts and preventing the transfer of contaminates from the environment to the decontamination unit and preventing transfer from one compartment to another.

Thus, the decontamination unit of the present invention is extremely effective in cleaning or decontaminating a contaminated individual, particularly an asbestos worker. Furthermore, it is extremely portable, being easy to disassemble and transport in several smaller components. It is also relatively inexpensive as compared to units of the prior art. Many other objects and advantages of the present invention will be apparent from reading the specification which follows in conjunction with the accompanying drawings.

DESCRIPTION OF A PREFERRED EMBODIMENT

Figure 1:
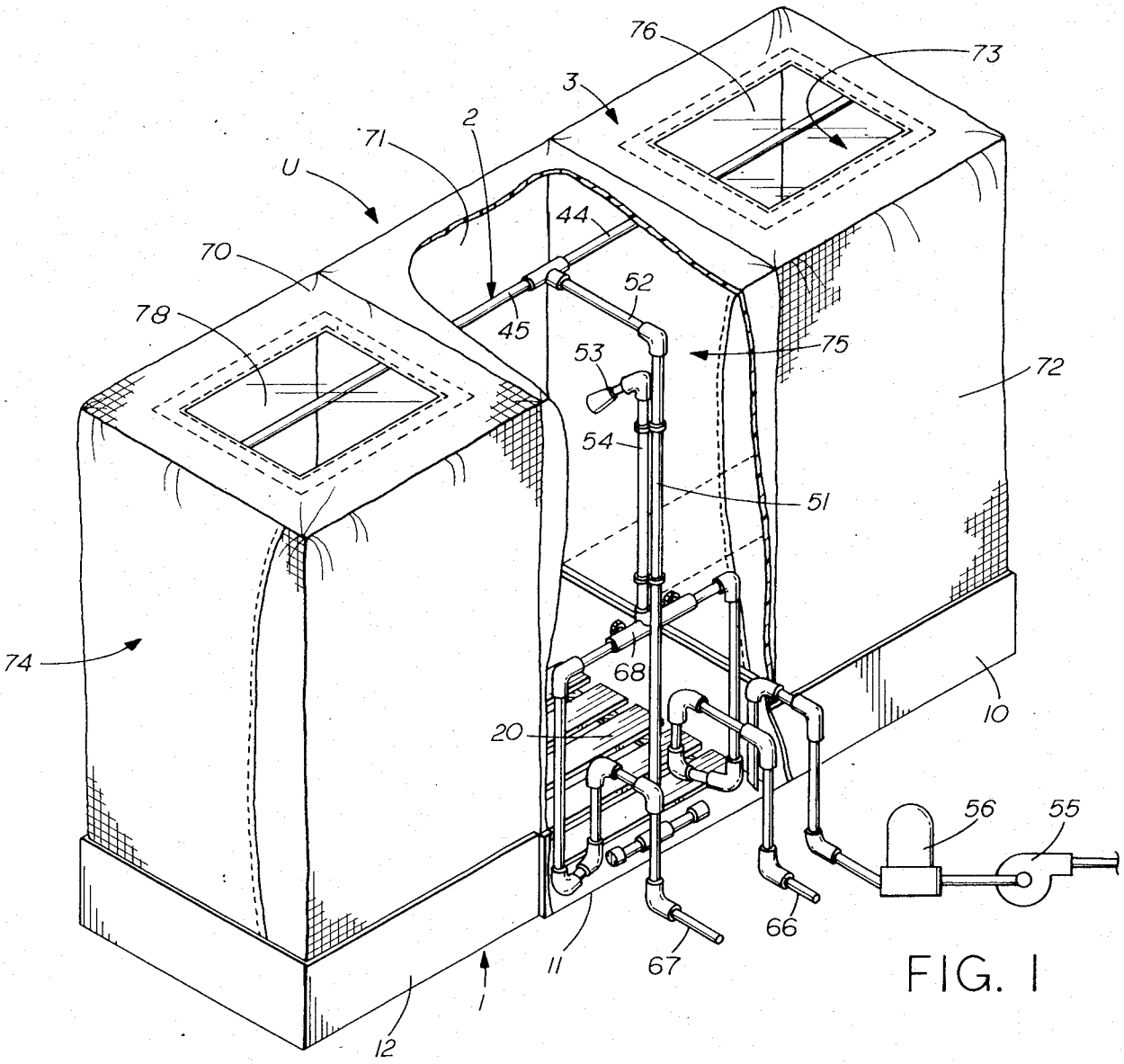
FIG. 1 is a perspective view of a portable decontamination unit, a portion of which has been cut away for better viewing, according to a preferred embodiment of the invention.
Figure 10:
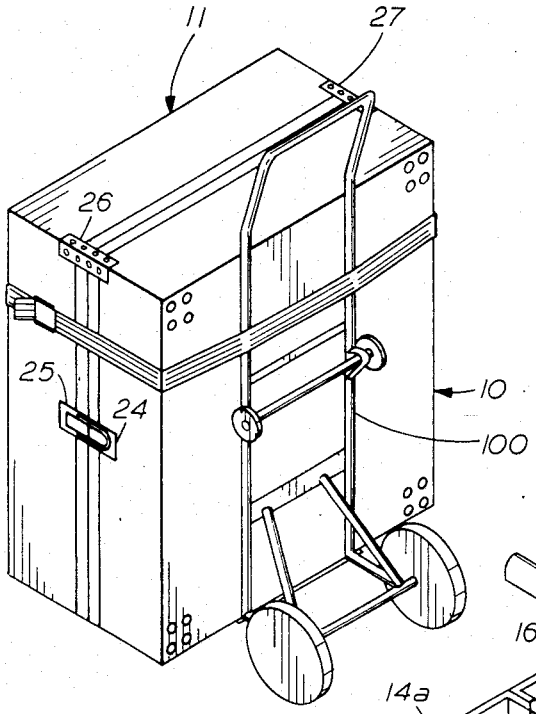
FIG. 10 is a pictorial representation of the decontamination unit of the present invention disassembled and packaged for movement from one location to another.
Figure 2:
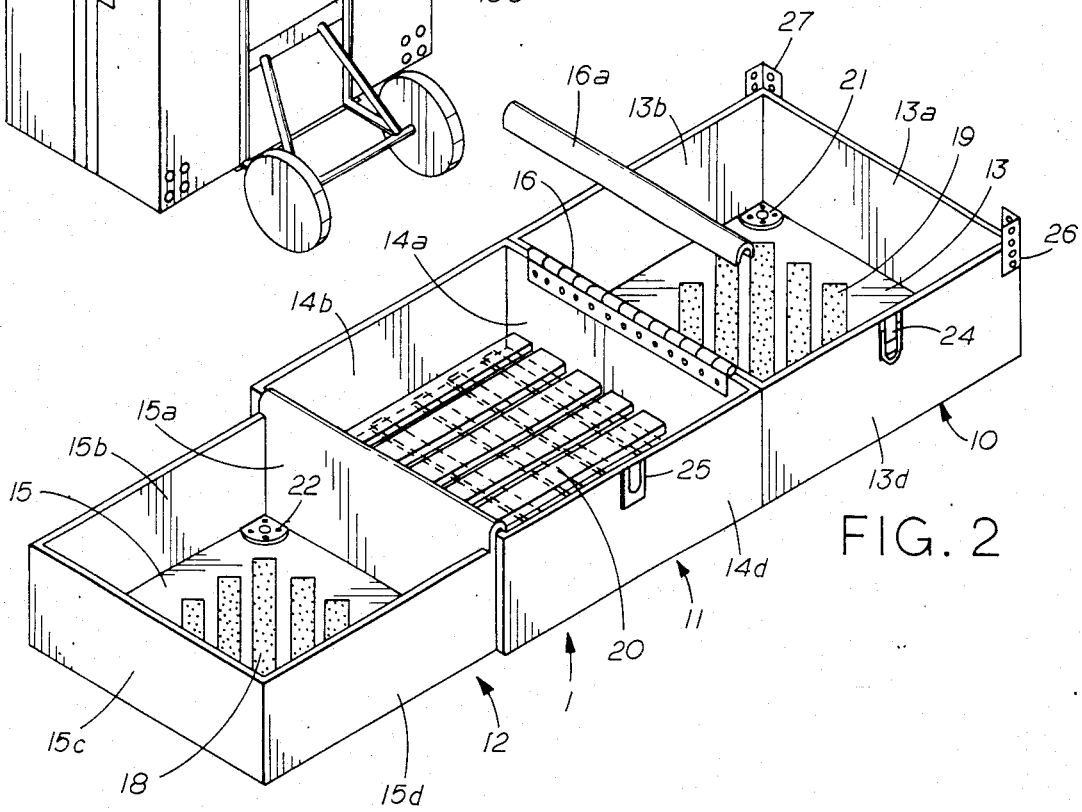
FIG. 2 is a perspective view of pans which form a subassembly of the portable decontamination unit of the present invention, according to a preferred embodiment thereof.
Figure 3:
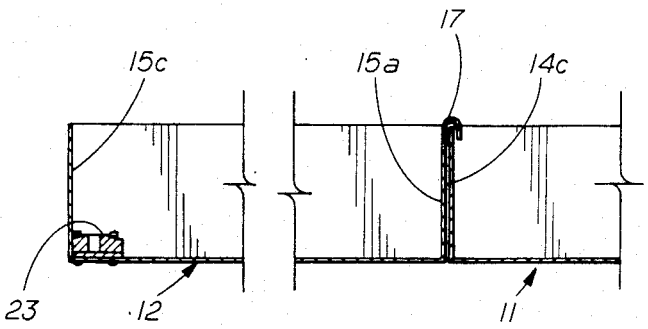
FIG. 3 is a sectional elevation view of two of the pans illustrated in FIG. 2, showing the cooperative connection thereof.

Referring first to FIG. 1, there is shown a decontamination unit U of the present invention made up of three subassemblies, a multiple pan base 1, a tent frame 2, and a tent 3. Referring also to FIGS. 2 and 3, the multiple pan base 1 may include first, second and third pans 10, 11 and 12, which each include a bottom 13, 14 and 15, extending upwardly from which are side walls 13*a*, 13*b*, 13*c*, 13*d*; 14*a*, 14*b*, 14*c*, 14*d*; and 15*a*, 15*b*, 15*c*, 15*d*. The pans 10, 11 and 12 are positionable side by side so that one of the side walls of each pan lies adjacent to one of the sidewalls of the adjacent pan. If desired, the adjacent sides 13*c* and 14*a* of the first and second pans 10 and 11 may be hingedly connected by a hinge member 16 so that upon hinged movement thereof, the two pans 10 and 11 may be brought together to form an enclosure, such as shown in FIG. 10. An elongated channel-like protective covering 16*a* may be provided for placement over the hinge 16 to prevent water from contacting the hinge or leaking between the side walls 13*c* and 14*a*, the need for which will be further understood hereafter.

The wall 15 of the third pan 12 may be provided with a protective lip 17 to prevent water from leaking through the area between adjacent walls 14*c* and 15*a* of pans 11 and 12, respectively. The third pan 12 in FIG. 2 is slightly smaller in lateral dimension than the first and second pans 10 and 11. Its sidewall 15*a* may be provided with a channel-like lip 17 allowing pan 12 to be placed adjacent pan 11, the lip 17 serving to seal or prevent water from entering the area between the adjacent sidewalls 14*c* and 15*a* (see FIG. 3). Since the pan 12 is slightly smaller than pans 10 and 11, it may be disassembled and placed within one of these pans for storage and moving, as will be further described hereafter.

If desired, friction strips 18 and 19 may be placed in the bottoms 15 and 13 of the pans 12 and 10 to prevent an individual standing in these pans from slipping. A wood strip platform 20 may be placed in the intermediate pan 11 so that an individual standing thereon will be elevated above the bottom 14 of the pan. In each corner of the bottom of pans 10 and 12 is a flange-like member, illustrated at 21, 22 and 23, attached thereto. Each of these flanges has a central hole for receiving components of the tent frame subassembly 2 as will be understood hereafter.

Figure 4:
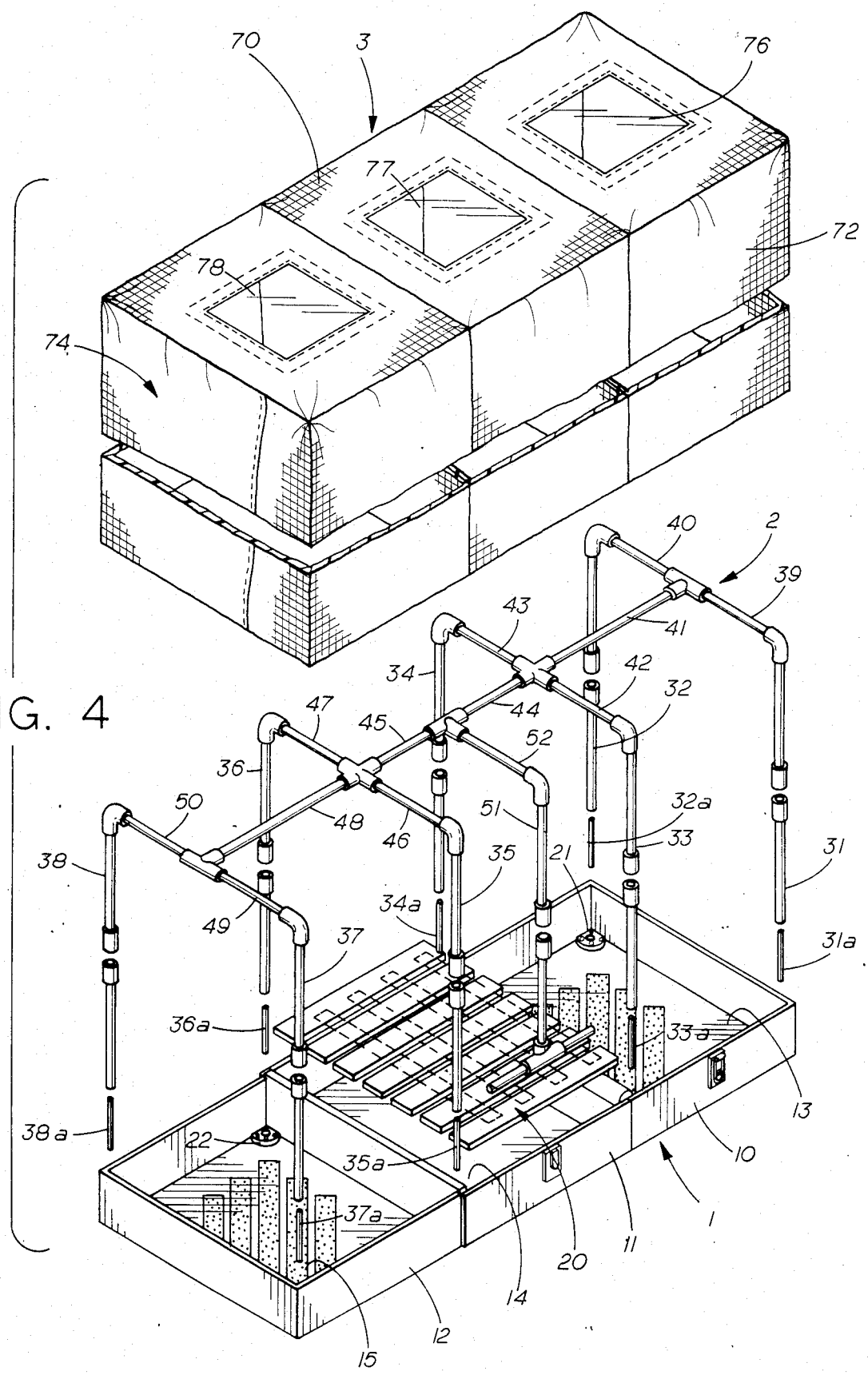
FIG. 4 is an exploded perspective view of the decontamination unit of FIG. 1.

As best seen in FIG. 4, the tent frame subassembly 2 comprises a plurality of vertical support members 31, 32, 33, 34, 35, 36, 37 and 38, extending upwardly from the corners of the pans 10, 11 and 12. These vertical support members 31–38 may be formed of a plurality of components so that they may be broken down into shorter elements. The lowermost component 31*a*–38*a* is a rod which engages a corresponding hole in one of the flange members (such as 21, 22, 23) in the corners of the pans 10, 11 and 12. The vertical support members 31–38 may be made of any suitable material or shape. However, as illustrated, they are made of a lightweight tubular material such as PVC.

The upper ends of the vertical support members 31–38 are attached by horizontal support members 39–50 which are interconnected by suitable ell, tee and cross connectors. In addition, a vertical support 51 and horizontal support 52 may be provided for supporting a shower manifold as best seen in FIG. 1.

Referring to FIG. 1, the shower manifold supported by vertical support 51 and horizontal support 52 may comprise a shower head 53 at the end of a vertical conduit 54 which is connected to cold water and hot water supply lines 66 and 67 by a number of pipes and connecting elements joining at a valve manifold 68.

Figure 5:
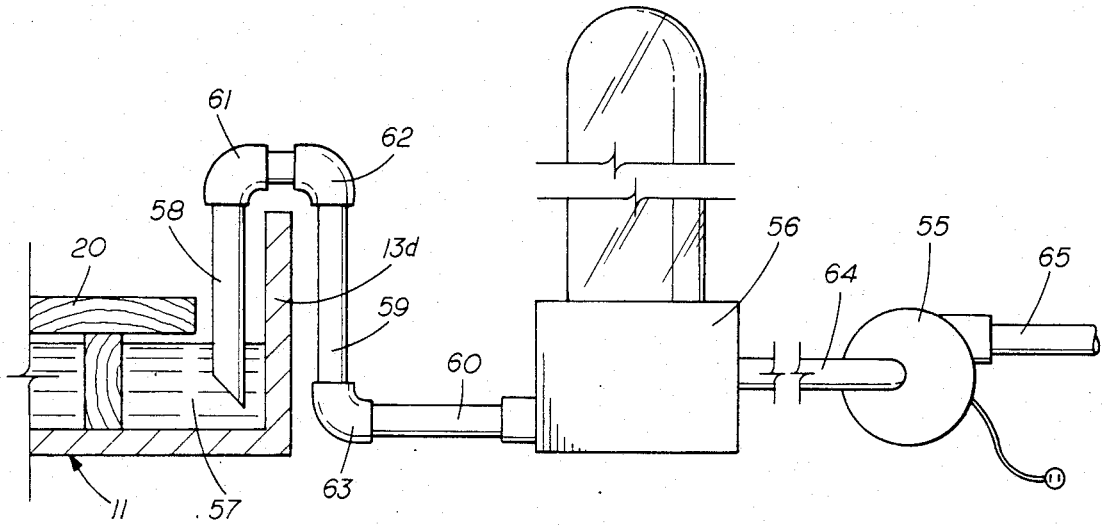
FIG. 5 is a schematic representation of a pump and filter unit for utilization with the decontamination unit of the present invention.

As one may readily understand, the water from the shower head 53 will collect in the pan 11 were it not removed by some means. For this reason, a pump 55 and filter 56 may be provided as seen in FIG. 1 and in more detail in FIG. 5. As seen in FIG. 5, a sump area 57 is provided below the platform 20 in the pan 11 for collecting water from the shower. Suction pipes 58, 59, 60 joined by suitable connectors 61, 62 and 63, are connected to a filter unit 56 which is in turn connected by conduit 64 to the inlet of a pump 55. Operation of the pump 55 will remove the water in the sump area 57 first for filtering of any solid materials therein through the filter 56 and then for discharge through discharge line 65 to a suitable drain or sewer line.

Referring now to FIGS. 1 and 4, the tent 3, preferably of a lightweight plastic material, is formed having an open bottom, a top 70, sides 71, 72, ends 73, 74 and at least one intermediate partition 75. The top 70 of the tent 3 may be made with a transparent window 76, 77, 78, so as to allow natural light into the compartments thereof.

The tent 3 is supportable on the tent frame 2, as best seen in FIG. 1, to form first, second and third compartments, the bottoms of which are the pans 10, 11 and 12, respectively. The first, second and third compartments are separated by intermediate partitions such as 75.

Figure 6:
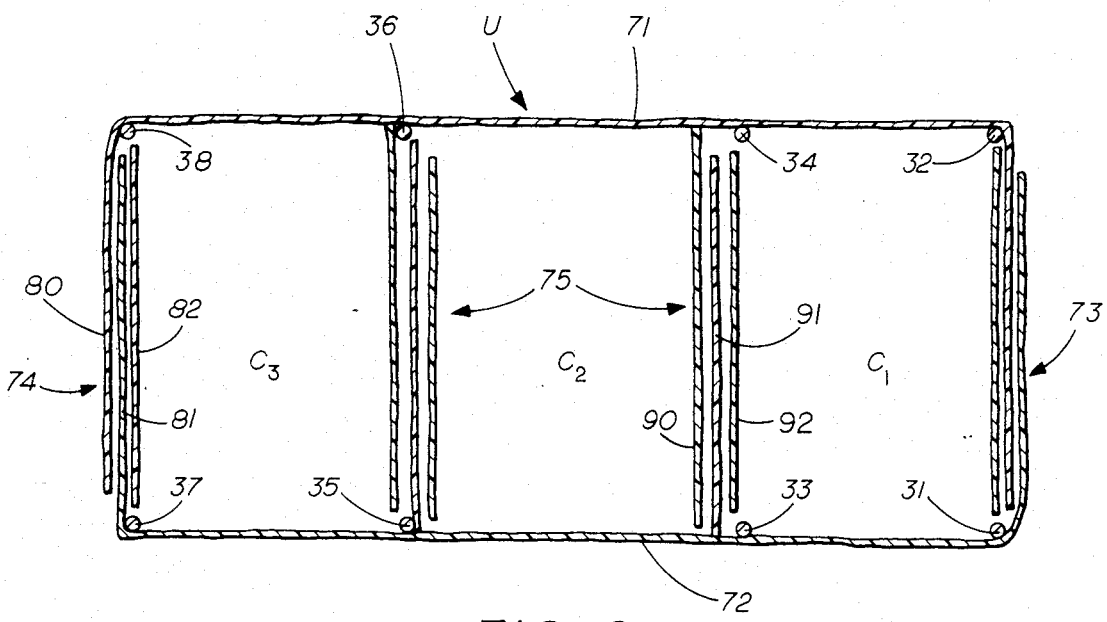
FIG. 6 is a longitudinal cross-section of the tent subassembly of the decontamination unit of the present invention.
Figure 7:
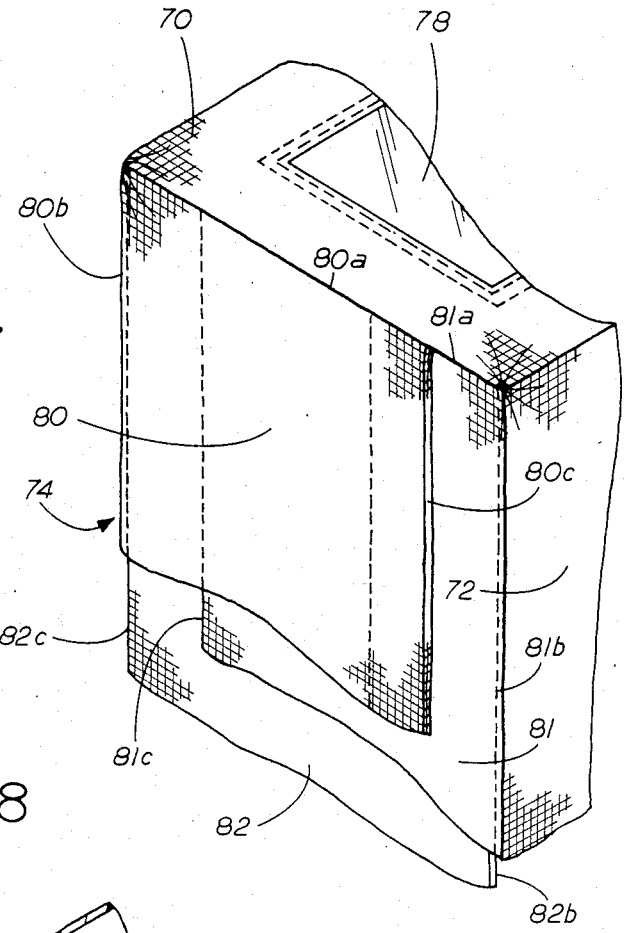
FIGS. 7, 8 and 9 are detailed views of portions of the tent subassembly of the decontamination unit of the present invention.

Referring now to FIGS. 6, 7, 8 and 9, details of the ends 73 and 74 of the tent 3 and the intermedaite partitions 75 will be described in greater detail. In FIG. 7, there is shown the upper portion of the end 74. The end 74 is formed of first, second and third curtains 80, 81 and 82, respectively. The first curtain 80 is attached along the upper edge 80*a* thereof to the top 70 of the tent 3 and along one vertical edge 80*b* to one side of the tent 3, leaving the opposite vertical edge 80*c* free. The second curtain 81 is attached along an upper edge 81*a* to the top 70 of the tent and along one vertical edge 81*b* to the opposite side 72 of the tent, leaving the opposite vertical edge 81*c* free. The third curtain 82 is attached along its upper edge (not seen in FIG. 7) to the top 70 of the tent and both of the vertical edges 82*b* and 82*c* are free. Thus, the three curtains 80, 81 and 82 overlap as seen in FIGS. 6 and 7. To enter or leave compartment $C_3$ (see FIG. 6) an individual simply pulls back one side of curtain 80 and the opposite side of curtain 81 and either side of curtain 82. Thus ingress and egress are permitted without a hinged door and in a manner much more likely to seal or prevent contaminants from entering the decontamination unit U.

Figure 8:
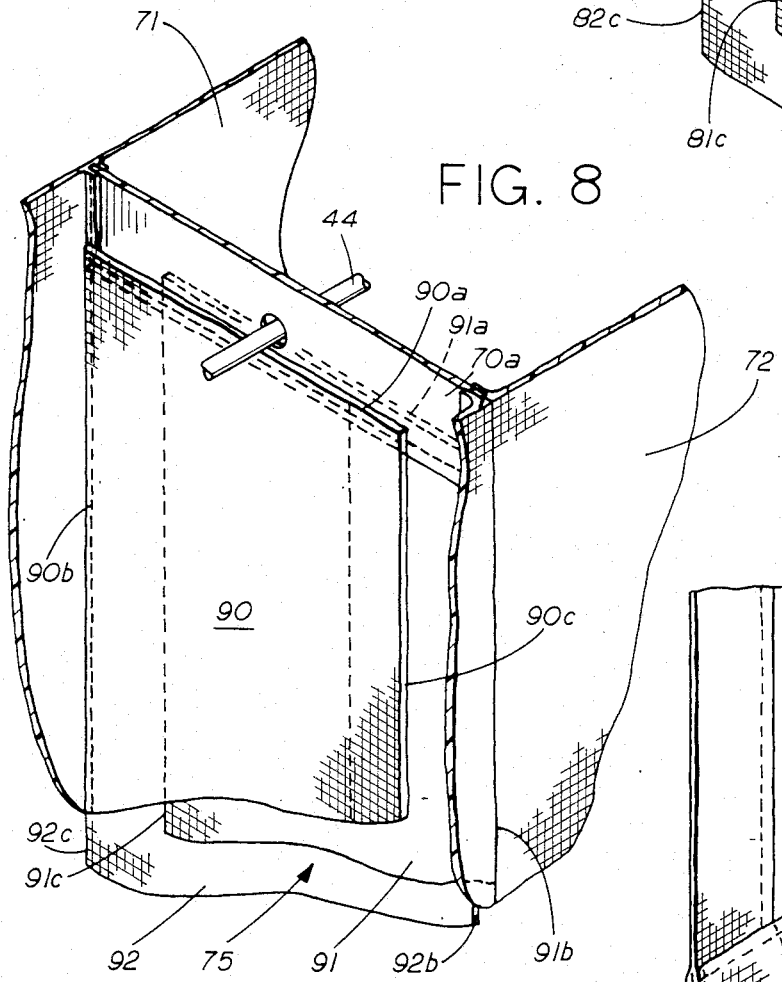

Referring also to FIG. 8, the construction of one of the partitions 75 will be seen. Similarly to the end 74 of FIG. 7, the partition 75 is formed by first, second and third curtains 90, 91 and 92. The first curtain 90 is attached along an upper edge 90*a* to the top of the tent or to a webbed support member 70*a* which may be attached at the top of the tent. (Note the horizontal support 44 of the tent frame passes through a hole in support web 70*a*). A vertical edge 90*b* is attached to one side 71 of the tent, leaving the opposite vertical edge 90*c* free. The upper edge 91*a* of the second curtain is also attached to the support web 70*a* and along one vertical edge 91*b* to an opposite side 72 of the tent, leaving the opposite vertical edge 91*c* free. The third curtain 92 is attached along an upper edge (not shown) to the support web 70*a* at the top of the tent leaving both of the vertical edges 92*b* and 92*c* free. These curtains overlap as seen in FIGS. 6 and 8 to essentially seal the compartments separated thereby from transfer of contaminants. However, ingress and egress between these adjoining compartments is permitted by pushing or pulling back the free edges of the curtains 90, 91 and 92.

Figure 9:
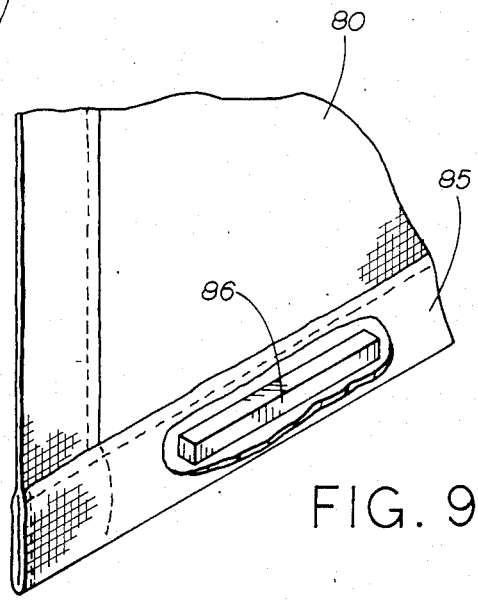

If desired, the lower edges of the curtains 80, 81, 82, 90, 91, 92, may be hemmed so as to provide a channel 85 such as shown in FIG. 9 for curtain 80, in which may be placed magnets 86 for attraction to pans 10, 11, 12 (if they are metal) so that the curtains will always tend to hand straight and be maintained within the respective pan 10, 11, 12, which forms the bottom of the compartments separated by the curtains.

Typically, the decontamination unit U will be assembled at the desired location by first placing the pan subassembly in position as shown in FIG. 2. Then the tent frame 2 will be assembled and attached to the flanges 21, 22, 23, etc. at the corners of the individual pans 10 and 12. The tent subassembly 3 will be placed over the tent frame 2. Then the shower manifold will also be attached or installed at this time so that the finally assembled unit will essentially appear as in FIG. 1.

In use, a contaminated worker will enter a first compartment through the curtains of the end 73. In the first compartment, the worker will remove his contaminated clothes and associated working apparatus. The first compartment may even be placed under a partial vacuum by a vacuum pump or blower so that no contaminants therein escape to the surrounding atmosphere. The worker may then enter the intermediate compartment via one of the partitions 75 where he may shower, removing all contaminants from his body. The residual water and contaminants will be removed by the pump 55 pumping from the sump area 57 below the platform 20. The contaminants are filtered by the filtering unit 56.

After the worker is thoroughly cleaned in the shower compartment, he then enters the third compartment through one of the curtain partitions 75 where he may change into clean clothes and eventually exit through the curtained end 74.

After a job is completed and it is desired to move the decontamination unit U to another location, it may be disassembled, the tent frame 2 being broken down into smaller components and the tent 3 being folded and placed in one of the hingedly connected pans 10 and 11. In fact, the third pan 12 may also be placed in one of these pans. With all components placed within one or both of these pans 10 and 11, the pans are closed together, similar to a suitcase as shown in FIG. 10, and held in this position by latches 24, 25, and connecting components 26 and 27 and placed on a cart 100 or the like for easy transport to another work location.

Thus, the decontamination unit U of the present invention is easy to assemble and disassemble and easily transportable between job sites. It is extremely effective for decontaminating workers who have been exposed to a dirty or contaminated work environment without transferring contaminants from one area to another. Its unique curtained ends and partitions provide easy ingress and egress between the compartments of the unit, while at the same time providing the necessary isolation of contaminants therein.

A single embodiment of the invention has been described herein utilizing three compartments. It is, of course, understood that the unit can be made with any number of compartments, two, three, four, or more. It should also be understood that the decontamination unit of the present invention might be appropriate for other uses. For example, the unit would be ideal for placing near a beach to allow swimmers to pass therethrough for showering and changing into dry and clean clothes. Thus, many variations of the invention can be made without departing from the spirit of the invention. Accordingly, it is intended that the scope of the invention be limited only by the claims which follow.

I claim:

1. A portable decontamination unit comprising:

first and second pans each of which includes a bottom and side walls extending upwardly therefrom, said pans being positionable side by side so that one of the side walls of each pan lies adjacent to one of the side walls of the adjacent pan;

a tent frame supportable on said pans; and a tent having a top, sides, ends and at least one intermediate partition supportable by said tent frame forming first and second compartments the bottoms of which are said first and second pans, respectively; said at least one intermediate partition being formed by first, second and third curtains, said first curtains being attached along an upper edge thereof to said top of said tent and along one vertical edge thereof to one side of said tent leaving the opposite vertical edge free, said second curtain being attached along an upper edge thereof to said top of said tent and along one vertical edge thereof to an opposite side of said tent leaving the opposite vertical edge free, said third curtain being attached along an upper edge thereof to said top of said tent and both of the vertical edges thereof being free.

2. A portable decontamination unit set forth in claim 1 in which said tent frame may be disassembled and may be placed with said tent within one or more of said pans for moving from one location to another.

3. A portable decontamination unit as set forth in claim 2 in which adjacent sides of said first and second pans are hingedly connected so that upon hinged movement thereof said two pans may be brought together to form an enclosure in which said disassembled tent frame and said tent may be carried from said one location to another.

4. A portable decontamination unit as set forth in claim 1 including sealing means along the edges of said adjacent pan side walls.

5. A portable decontamination unit as set forth in claim 1 in which said pans are quadrilateral in shape and in which said tent frame comprises vertical support members extending upwardly from the corners of said quadrilateral pans, the upper ends of said vertical support members being attached by horizontal support members.

6. A portable decontamination unit as set forth in claim 5 in which said vertical and horizontal support members are detachable from each other allowing said tent and said tent frame to be taken down for storage and transportation to another site.

7. A portable decontamination unit as set forth in claim 1 in which at least one of said compartments is provided with shower means for washing an individual occupying said one of said compartments.

8. A portable decontamination unit as set forth in claim 7 including means for draining the pan of said one of said compartments.

9. A portable decontamination unit as set forth in claim 8 in which said means for draining the pan of said one of said compartments includes a pump the suction side of which communicates with the bottom of said pan through a suction conduit.

10. A portable decontamination unit as set forth in claim 8 including a platform placeable in said pan of said one of said compartments so as to elevate the feet of said individual above the bottom of said pan forming a sump area below in which water may collect for removal from said pan by said draining

11. A portable decontamination unit as set forth in claim 1 including a third pan having a bottom and upwardly extending side walls, said third pan being positional side by side to said second pan, said tent and said at least one intermediate partition including first and second intermediate partitions which separate said first, second and third compartments.

12. A portable decontamination unit as set forth in claim 11 in which said tent frame may be disassembled and may be placed with said tent within one or more of said pans for moving from one location to another.

13. A portable decontamination unit as set forth in claim 12 in which said first and second pans are hingedly connected so that upon hinged movement thereof said two pans may be brought together to form an enclosure in which said disassembled tent frame and tent may be carried from said one location to another.

14. A portable decontamination unit as set forth in claim 13 in which said third pan is slightly smaller than said first and second pans allowing said third pan to be carried in said enclosure formed thereby.

15. A portable decontamination unit comprising:

first, second and third pans each of which includes a bottom and side walls extending upwardly therefrom, said pans being positionable side by side so that one of the side walls of each pan lies adjacent to one of the side walls of an adjacent pan;

a tent frame supportable above said pans; and a tent having a top, sides, ends and first and second intermediate partitions supportable by said tent frame forming first, second and third compartments, the bottoms of which are said first, second and third pans, respectively, said second compartment lying intermediate said first and third compartments and being separated therefrom by said first and second intermediate partitions; each of said first and second intermediate partitions being formed by first, second and third curtains, said first curtain being attached along an upper edge thereof to said top of said tent and along one vertical edge thereof to one side of said tent leaving the opposite vertical edge free, said second curtain being attached along an upper edge thereof to said top of said tent and along one vertical edge thereof to an opposite side of said tent leaving the opposite vertical edge free, said third curtain being attached along an upper edge thereof to said top of said tent and both of the vertical edges thereof being free.

16. A portable decontamination unit as set forth in claim 15 in which each of said ends of said tent are also formed by first, second and third curtains, said first curtain being attached along an upper edge thereof to said top of said tent and along one vertical edge thereof to one side of said tent leaving the opposite vertical edge free, said said second curtain being attached along an upper edge thereof to said top of said tent and along one vertical edge thereof to an opposite side of said tent leaving the opposite vertical edge free, said third curtain being attached along an upper edge thereof to said top of said tent and both of the vertical edges thereof being free.

17. A portable decontamination unit as set forth in claim 15 in which said second compartment is provided with shower means for washing an individual occupying said second compartment and means for draining water from the pan thereof.

18. An improved portable decontamination unit enclosed by a top, bottom, sides and ends and divided into at least two compartments by at least one intermediate partition, characterized in that said intermediate partition is formed by first, second and third curtains, said first curtain being attached along an upper edge thereof to the top of said unit and along one vertical edge thereof to one side of said unit leaving the opposite vertical edge free, said second curtain being attached along an upper edge thereof to said unit top and along a vertical edge thereof to an opposite side of said unit leaving the opposite vertical edge free, said third curtain being attached along an upper edge thereof to said unit top and both of the vertical edges being free.

19. A portable decontamination unit as set forth in claim 18 in which each of the ends of said unit are also formed by first, second and third curtains, said first curtains being attached along an upper edge thereof to said unit top and along one vertical edge thereof to one side of said unit leaving the opposite vertical edge free, said second curtain being attached along an upper edge thereof to said unit top and along one vertical edge thereof to an opposite side of said unit leaving the opposite vertical edge free, said third curtain being attached along an upper edge thereof to said unit top and both of the vertical edges being free.

* * * * *